US010395611B2

(12) United States Patent
Zheng et al.

(10) Patent No.: US 10,395,611 B2
(45) **Date of Patent: *Aug. 27, 2019**

(54) CONTENT-BASED VCOM DRIVING

(71) Applicant: Apple Inc., Cupertino, CA (US)

(72) Inventors: Fenghua Zheng, San Jose, CA (US); Howard H. Tang, San Diego, CA (US); James C. Aamold, Campbell, CA (US); Sandro H. Pintz, Menlo Park, CA (US); Chaohao Wang, Sunnyvale, CA (US); Paolo Sacchetto, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/701,001

(22) Filed: Sep. 11, 2017

(65) Prior Publication Data

US 2018/0068624 A1 Mar. 8, 2018

Related U.S. Application Data

(63) Continuation of application No. 14/640,931, filed on Mar. 6, 2015, now Pat. No. 9,761,188.

(51) Int. Cl.
*G09G 3/20* (2006.01)
*G09G 3/36* (2006.01)

(52) U.S. Cl.
CPC ..... *G09G 3/3614* (2013.01); *G09G 3/3655* (2013.01); *G09G 2320/029* (2013.01); *G09G 2320/0223* (2013.01); *G09G 2340/16* (2013.01)

(58) Field of Classification Search
CPC .. G09G 2340/16; G09G 3/00; G09G 2340/00; G09G 2340/14; G09G 2310/021; G09G 2310/0205; G09G 2310/0202; G09G 2310/02; G09G 2310/00; G09G 3/3696; G09G 3/006; G09G 3/3614; G09G 2310/08; G09G 2320/0223; G09G 2330/12; G09G 2310/0291; G09G 3/3655; G09G 2320/029
See application file for complete search history.

(56) References Cited

U.S. PATENT DOCUMENTS 5,926,157 A * 7/1999 Moon ..... G09G 3/3648 345/58
6,492,970 B1 * 12/2002 Furuhashi ..... G09G 3/3614 345/94
7,151,518 B2 * 12/2006 Fukumoto ..... G09G 3/3688 345/96
7,319,448 B2 * 1/2008 Kim ..... G02F 1/134363 345/87

(Continued)

FOREIGN PATENT DOCUMENTS

JP 2004354758 A * 12/2004

*Primary Examiner* — Julie Anne Watko
(74) *Attorney, Agent, or Firm* — Fletcher Yoder, P.C.

(57) ABSTRACT

Methods and systems for compensating for VCOM variations include determining a voltage change in pixels between frames to be displayed on an electronic display. Based on the determined voltage change, VCOM variation is calculated based on coupling the VCOM to one or more data lines of the electronic display. VCOM compensation is determined and applied to offset for the VCOM variation. Using the VCOM offset, subsequent pixel content for the one or more pixels is written using the compensated VCOM.

18 Claims, 8 Drawing Sheets

(56) References Cited

U.S. PATENT DOCUMENTS

| | | | | |
|---|---|---|---|---|
| 7,652,649 | B2 * | 1/2010 | Huang | G02F 1/136213 345/90 |
| 7,864,150 | B2 * | 1/2011 | Shih | G09G 3/3659 345/53 |
| 7,868,869 | B2 * | 1/2011 | Shin | G09G 3/344 345/107 |
| 8,054,274 | B2 * | 11/2011 | Chen | G09G 3/3655 345/96 |
| 8,416,175 | B2 * | 4/2013 | Hong | G09G 3/3614 345/96 |
| 8,421,728 | B2 * | 4/2013 | Takatori | G09G 3/3655 345/94 |
| 8,477,123 | B2 * | 7/2013 | Tomohiro | G09G 3/3655 345/204 |
| 8,878,881 | B2 * | 11/2014 | Li | G09G 3/3607 345/211 |
| 2003/0006979 | A1 * | 1/2003 | Tsuchi | G09G 3/3688 345/204 |
| 2003/0156104 | A1 * | 8/2003 | Morita | G09G 3/2011 345/204 |
| 2008/0278429 | A1 * | 11/2008 | Chen | G09G 3/3655 345/98 |
| 2008/0309590 | A1 * | 12/2008 | Hong | G09G 3/3614 345/52 |
| 2009/0009446 | A1 * | 1/2009 | Kamijo | G09G 3/3655 345/87 |
| 2009/0267884 | A1 * | 10/2009 | Takahashi | G09G 3/3648 345/96 |
| 2012/0268481 | A1 * | 10/2012 | Niioka | H04N 13/317 345/619 |
| 2014/0375537 | A1 * | 12/2014 | Chung | G09G 3/344 345/107 |

* cited by examiner

CONTENT-BASED VCOM DRIVING

CROSS REFERENCE TO RELATED APPLICATIONS

This application is a continuation of U.S. application Ser. No. 14/640,931, filed on Mar. 6, 2015, the contents of which are herein expressly incorporated by reference for all purposes.

BACKGROUND

The present disclosure relates generally to electronic displays, and more particularly, to adjusting VCOM driving for a display based on content.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Generally, an electronic display may enable information to be communicated to a user by displaying visual representations of the information, for example, as pictures, text, or videos. More specifically, the visual representations may be displayed as successive static image frames. In some embodiments, each image frame may be displayed by successively writing image data to rows of pixels in the electronic display.

In addition to outputting information, the electronic display includes a VCOM that connects to pixel capacitor of unit pixels in the electronic display to connect the pixel capacitors to a common voltage. When pixels change, current may be injected into a dataline for a unit pixel. Resulting in a voltage variation in the VCOM due to dataline and VCOM coupling. The display during this voltage variation may result in display artifacts and/or improper final pixel voltages due to writing during VCOM voltage settling. In scenarios where the display has a relatively high refresh rate (e.g., 120 or 240 Hz), the period for the VCOM to settle is reduced. Furthermore, in scenarios where high voltage slewing is applied to the VCOM and/or the dataline may increase VCOM settling times. Moreover, VCOM settling time increases may increase when column or row drivers switch in the same direction simultaneously. Thus, it may be desirable to compensate for the charge.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving display appearance by reducing or eliminating artifacts resulting from coupling a VCOM to one or more datalines. Typically, when uncompensated VCOMs are coupled to one or more datalines through pixel circuitry, the VCOM is injected with some charge from the one or more connected datalines. Such injection of charge to the VCOM may result in display artifacts (e.g., greenish hue) while the VCOM is settling to a voltage level appropriate for the pixel content to be displayed.

Such VCOM variations may be pre-determined before coupling the VCOM to the one or more datalines. The VCOM may then be injected with charge to offset the calculated variations that would result from the coupling. Accordingly, the VCOM variation may be reduced or eliminated by setting the VCOM to the compensation level before (or during) the connection of the VCOM to the one or more datalines.

In some embodiments, the compensated VCOM may be calculated using a next line buffer that includes pixel content for one or more pixels to be displayed next while another line buffer is used to write pixel content to the one or more pixels currently displayed. Accordingly, the pre-compensation includes determining and compensating for future VCOM variations before the variations occur.

BRIEF DESCRIPTION OF THE DRAWINGS

Various aspects of this disclosure may be better understood upon reading the following detailed description and upon reference to the drawings in which.

DETAILED DESCRIPTION

Figure 1:
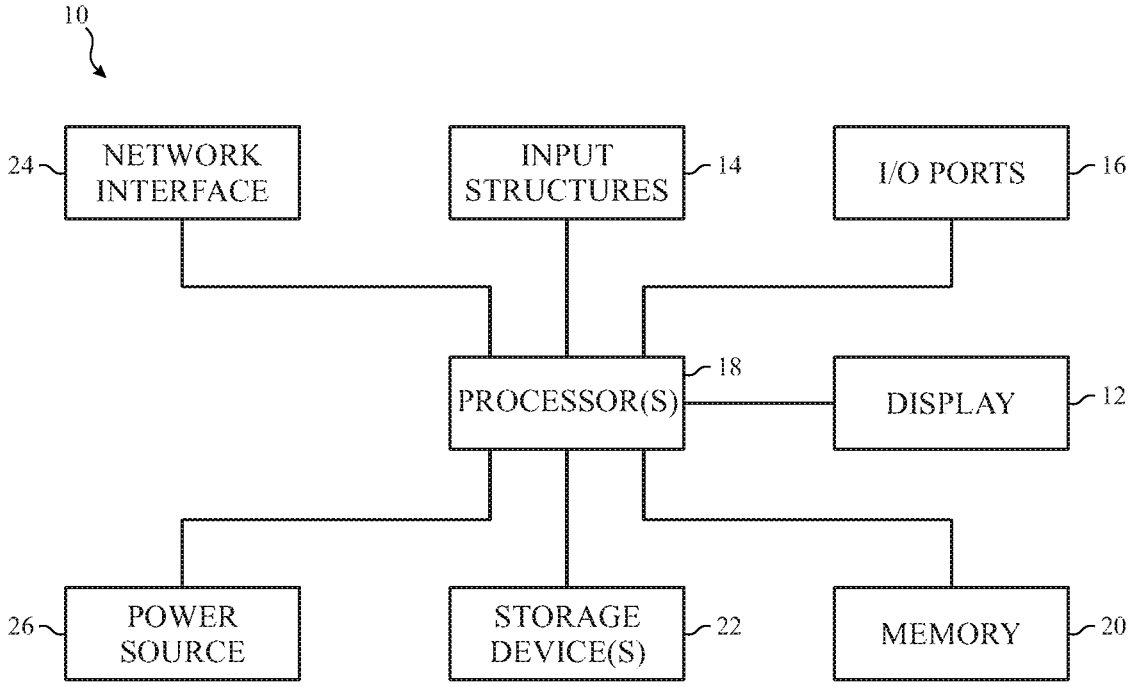
FIG. 1 is a block diagram of a computing device, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As previously discussed, the present disclosure generally relates to reducing or eliminating artifacts resulting from coupling a VCOM to one or more datalines. Typically, when uncompensated VCOMs are coupled to one or more datalines through pixel circuitry, the VCOM is injected with some charge from the one or more connected datalines. Such injection of charge to the VCOM may result in display artifacts (e.g., greenish hue) while the VCOM is settling to a voltage level appropriate for the pixel content to be displayed.

Such VCOM variations may be pre-determined before coupling the VCOM to the one or more datalines. The VCOM may then be injected with charge to offset the calculated variations that would result from the coupling. Accordingly, the VCOM variation may be reduced or eliminated by setting the VCOM to the compensation level before (or during) the connection of the VCOM to the one or more datalines.

In some embodiments, the compensated VCOM may be calculated using a next line buffer that includes pixel content for one or more pixels to be displayed next while another line buffer is used to write pixel content to the one or more pixels currently displayed. Accordingly, the pre-compensation includes determining and compensating for future VCOM variations before the variations occur. Furthermore, in some embodiments, the refresh rate may vary by content or even within content. For example, some content (e.g., movies) may have a set refresh rate (e.g., 24 Hz) while other content (e.g., specific application programs) may have dynamically determined refresh rates or may specify a specific refresh rate. This refresh rate information may be used in determine when and/or how often to compensate for expected VCOM fluctuations due to coupling the VCOM to a data line.

To help illustrate, a electronic device 10 that varies VCOM driving based on content is described in FIG. 1. As will be described in more detail below, the electronic device 10 may be any suitable computing device, such as a handheld computing device, a tablet computing device, a notebook computer, and the like.

Accordingly, as depicted, the electronic device 10 includes the display 12, input structures 14, input/output (I/O) ports 16, one or more processor(s) 18, memory 20, nonvolatile storage 22, a network interface 24, and a power source 26. The various components described in FIG. 1 may include hardware elements (including circuitry), software elements (including computer code stored on a non-transitory computer-readable medium), or a combination of both hardware and software elements. It should be noted that FIG. 1 is merely one example of a particular implementation and is intended to illustrate the types of components that may be present in the electronic device 10. Additionally, it should be noted that the various depicted components may be combined into fewer components or separated into additional components. For example, the one or more processors 18 may include a graphical processing unit (GPU) and/or a central processing unit (CPU).

As depicted, the processor 18 is operably coupled with memory 20 and/or nonvolatile storage device 22. More specifically, the processor 18 may execute instructions stored in memory 20 and/or non-volatile storage device 22 to perform operations in the electronic device 10, such as outputting image data to the display 12. As such, the processor 18 may include one or more general purpose microprocessors, one or more application specific processors (ASICs), one or more field programmable logic arrays (FPGAs), or any combination thereof. Additionally, memory 20 and/or non volatile storage device 22 may be a tangible, non-transitory, computer-readable medium that stores instructions executable by and data to be processed by the processor 18. In other words, the memory 20 may include random access memory (RAM) and the non-volatile storage device 22 may include read only memory (ROM), rewritable flash memory, hard drives, optical discs, and the like. By way of example, a computer program product containing the instructions may include an operating system or an application program.

Additionally, as depicted, the processor 18 is operably coupled with the network interface 24 to communicatively couple the electronic device 10 to a network. For example, the network interface 24 may connect the electronic device 10 to a personal area network (PAN), such as a Bluetooth network, a local area network (LAN), such as an 802.11 Wi-Fi network, and/or a wide area network (WAN), such as a 4G or LTE cellular network. Furthermore, as depicted, the processor 18 is operably coupled to the power source 26, which provides power to the various components in the electronic device 10. As such, the power source 26 may include any suitable source of energy, such as a rechargeable lithium polymer (Li-poly) battery and/or an alternating current (AC) power converter.

As depicted, the processor 18 is also operably coupled with I/O ports 16, which may enable the electronic device 10 to interface with various other electronic devices, and input structures 14, which may enable user interaction with the electronic device 10. Accordingly, the inputs structures 14 may include buttons, keyboards, mice, trackpads, and the like. In addition to the input structures 14, in some embodiments, the display 12 may include touch sensing components to enable user inputs via user touches to the surface of the display 12. In fact, in some embodiments, the electronic display 12 may detect multiple user touches at once.

In addition to enabling user inputs, the display 12 may display visual representations via one or more static image frames. In some embodiments, the visual representations may be a graphical user interface (GUI) for an operating system, an application interface, text, a still image, or a video. As depicted, the display 12 is operably coupled to the processor 18, which may enable the processor 18 (e.g., image source) to output image data to the display 12.

Based on the received image data, the display 12 may then write image frames to the display pixels in the display 12 to display a visual representation. As will be described in more detail below, a VCOM of the display 12 may be adjusted to compensate for VCOM variations that occur from coupling the VCOM to one or more datalines of the display.

Figure 2:
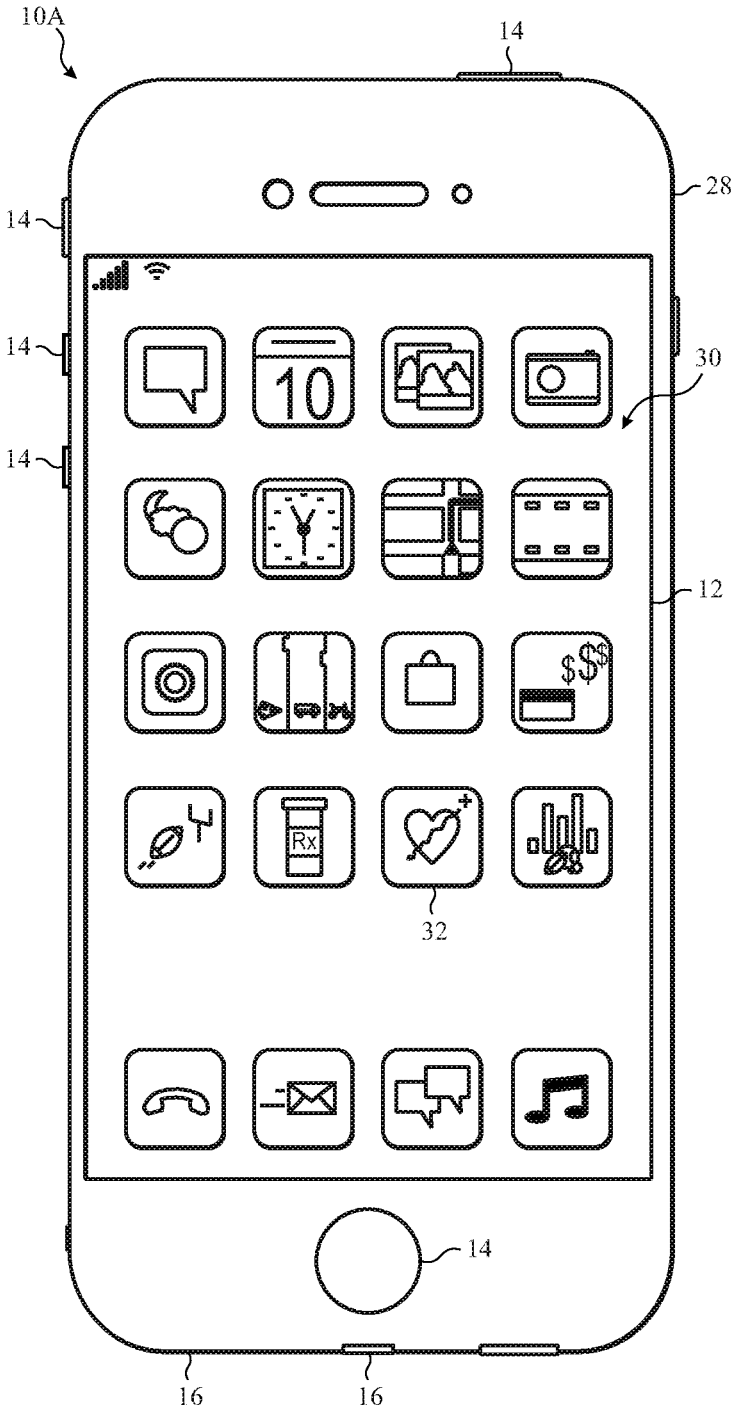
FIG. 2 is an example of the computing device of FIG. 1, in accordance with an embodiment.

As described above, the electronic device 10 may be any suitable electronic device. To help illustrate, one example of a handheld device 10A is described in FIG. 2, which may be a portable phone, a media player, a personal data organizer, a handheld game platform, or any combination of such devices. For example, the handheld device 10A may be any iPhone model from Apple Inc. of Cupertino, Calif.

As depicted, the handheld device 10A includes an enclosure 28, which may protect interior components from physical damage and to shield them from electromagnetic interference. The enclosure 28 may surround the display 12, which, in the depicted embodiment, displays a graphical user interface (GUI) 30 having an array of icons 32. By way of example, when an icon 32 is selected either by an input structure 14 or a touch sensing component of the display, an application program may launch.

Additionally, as depicted, input structure 14 may open through the enclosure 28. As described above, the input structures 14 may enable a user to interact with the handheld device 10A. For example, the input structures 14 may activate or deactivate the handheld device 10A, navigate a user interface to a home screen, navigate a user interface to a user-configurable application screen, activate a voice-recognition feature, provide volume control, and toggle between vibrate and ring modes. Furthermore, as depicted, the I/O ports 16 open through the enclosure 28. In some embodiments, the I/O ports 16 may include, for example, an audio jack to connect to external devices.

Figure 3:
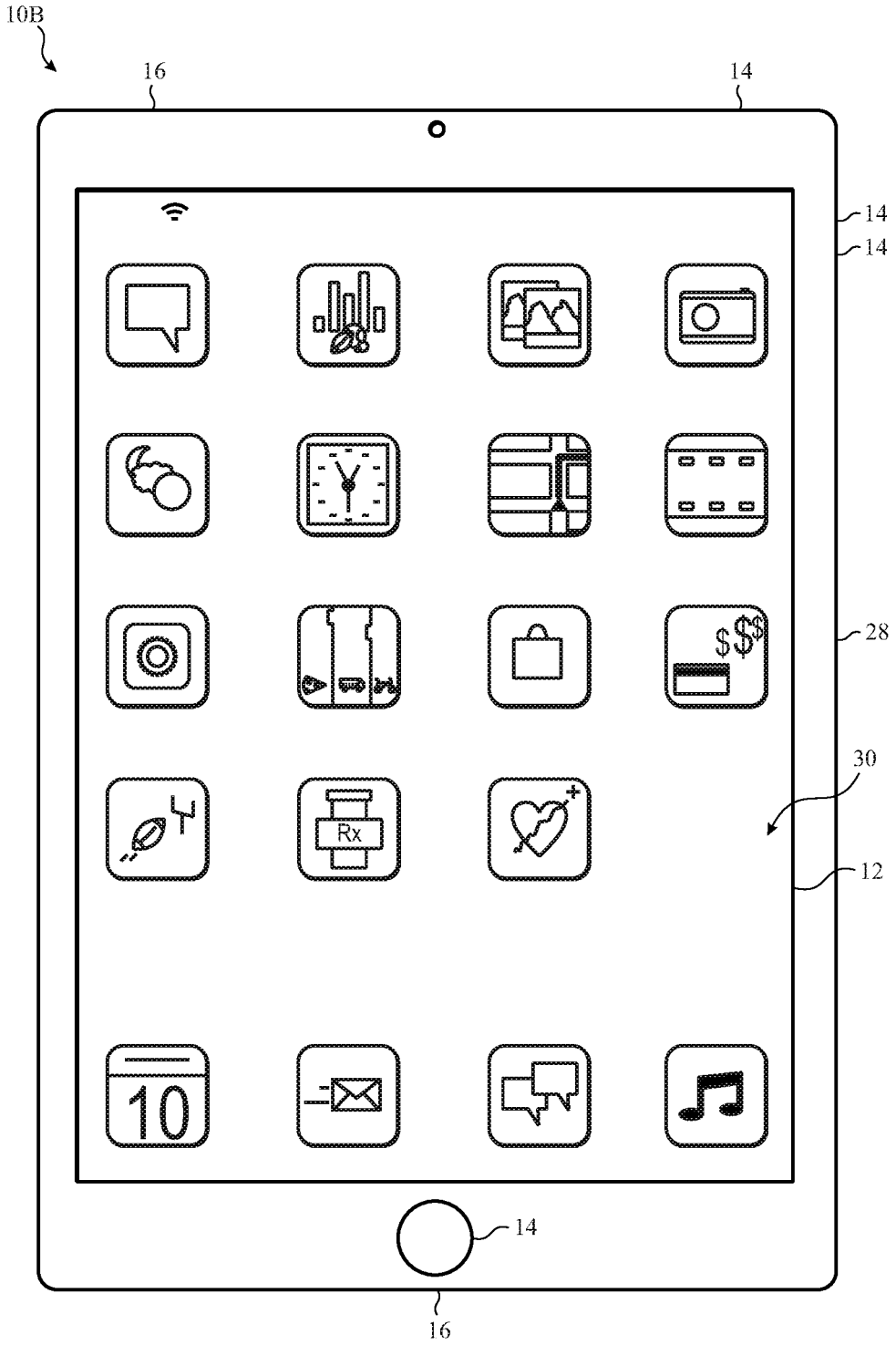
FIG. 3 is an example of the computing device of FIG. 1, in accordance with an embodiment.
Figure 4:
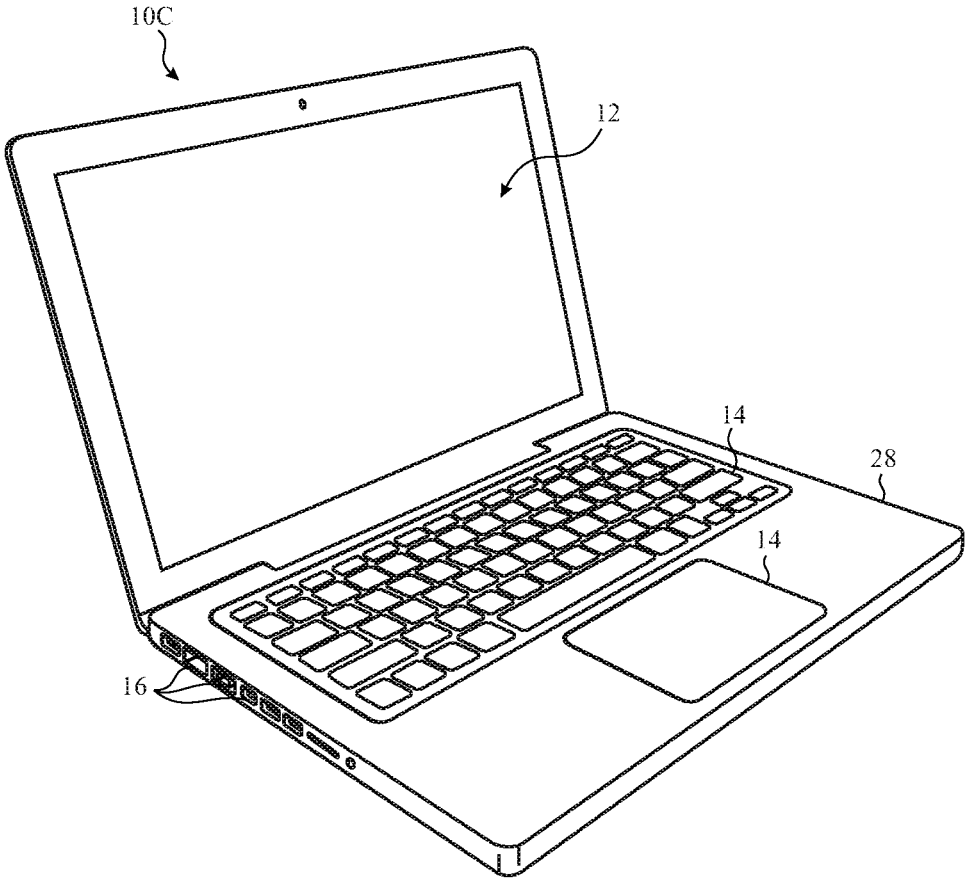
FIG. 4 is an example of the computing device of FIG. 1, in accordance with an embodiment.

To further illustrate a suitable electronic device 10, a tablet device 10B is described in FIG. 3, such as any iPad model available from Apple Inc. Additionally, in other embodiments, the electronic device 10 may take the form of a computer 10C as described in FIG. 4, such as any MacBook or iMac model available from Apple Inc. As depicted, the computer 10C also includes a display 12, input structures 14, I/O ports 16, and an enclosure 28.

As described above, the display 12 may facilitate communication of information between the electronic device 10 and a user, for example, by displaying visual representations based on image data received from the processor 18 and detecting user touch on the surface of the display 12. To help illustrate, a portion 34 of the electronic device 10 is described in FIG. 5. As depicted, the processor 18 and the display 12 are communicatively coupled via a data bus 36, which may enable the processor 18 to transmit image data to the display 12 indicating occurrence and/or position of a user touch to the processor 18.

Figure 6:
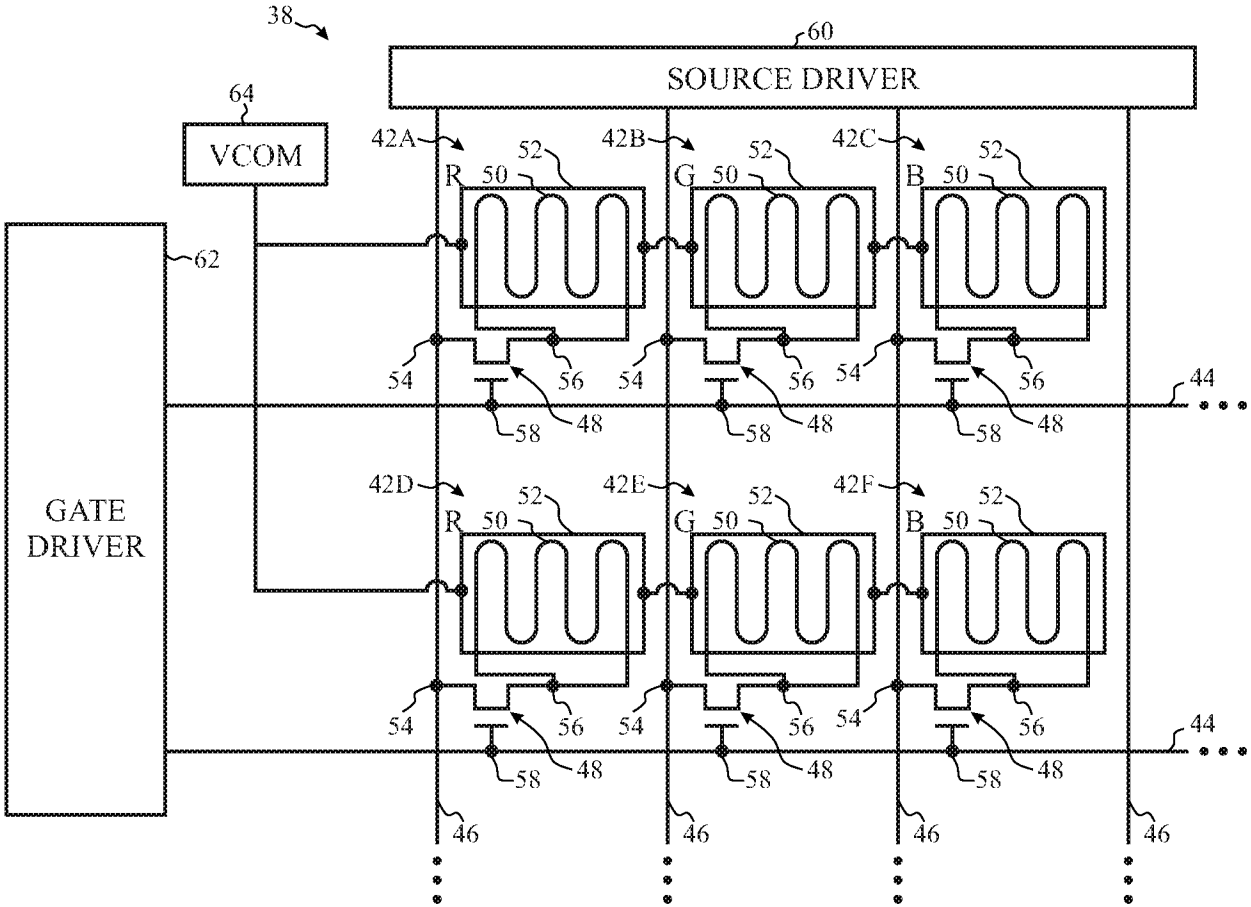
FIG. 6 is a schematic diagram of display components of an electronic display, in accordance with an embodiment.

To facilitate such operations, the display 12 may include display components (e.g., display driver circuitry) 38 and touch sensing components (e.g., touch sensing circuitry) 40. More specifically, the display components 38 may include any suitable components used to display an image frame on the display 12. For example, when the display 12 is a liquid crystal display, the display components 38 may include a thin film transistor (TFT) layer and a liquid crystal layer organized as display pixels. To help illustrate, operation of display components 38 used in a liquid crystal display are described in FIG. 6.

In the depicted embodiment, the display components 38 include a number of display pixels 42 disposed in a pixel array or matrix. More specifically, each display pixel 42 may be defined at the intersection of a gate line 44 (e.g. scanning line) and a source lines 46 (e.g., data line). Although only six display pixels 42, referred to individually by the reference numbers 42A-42F, are shown for purposes of simplicity, it should be understood that in an actual implementation, each source line 46 and gate line 44 may include hundreds or thousands of such display pixels 42.

As described above, image data may be written to each of the display pixels 42 to display an image frame. More specifically, image data may be written to a display pixel 42 by using a thin film transistor 48 to selectively store an electrical potential (e.g., voltage) on a respective pixel electrode 50. Accordingly, in the depicted embodiment, each thin film transistor 48 includes a source, which is electrically connected to a source line 46, a drain 56, which is electrically connected to a pixel electrode 50, and a gate 58, which is electrically connected to a gate line 54.

Thus, to write image data to a row of display pixels 42 (e.g., 42A-42C), the corresponding TFT gates 48 may be activated (e.g., turned on) by a scanning signal on the gate line 44. Image data may then be written to the row of display pixels by storing (e.g., via a capacitor) an electrical potential corresponding with the grayscale value of the image data from the source lines 46 to the pixel electrode 50. The potential stored on the pixel electrode 50 relative to a potential of a common electrode 52 may then generate an electrical field sufficient to alter the arrangement of the liquid crystal layer (not shown). More specifically, this electrical field may align the liquid crystal molecules within the liquid crystal layer to modulate light transmission through the display pixel 42. In other words, as the electrical field changes, the amount of light passing through the display pixel 42 may increase or decrease. As such, the perceived brightness level of the display pixel 42 may be varied by adjusting the grayscale value of the image data. In this manner, an image frame may be displayed by successively writing image data the rows of display pixels 42.

To facilitate writing image data to the display pixels 42, the display components 38 may also include a source driver 60, a gate driver 62, and a common voltage (Vcom) source 64. More specifically, the source driver 60 may output the image data (e.g., as an electrical potential) on the source lines 46 to control electrical potential stored in the pixel electrodes 50. Additionally, the gate driver 62 may output a gate signal (e.g., as an electrical potential) on the gate lines 44 to control activation of rows of the display pixels 42. Furthermore, the Vcom source 64 may provide a common voltage to the common electrodes 52.

Figure 7:
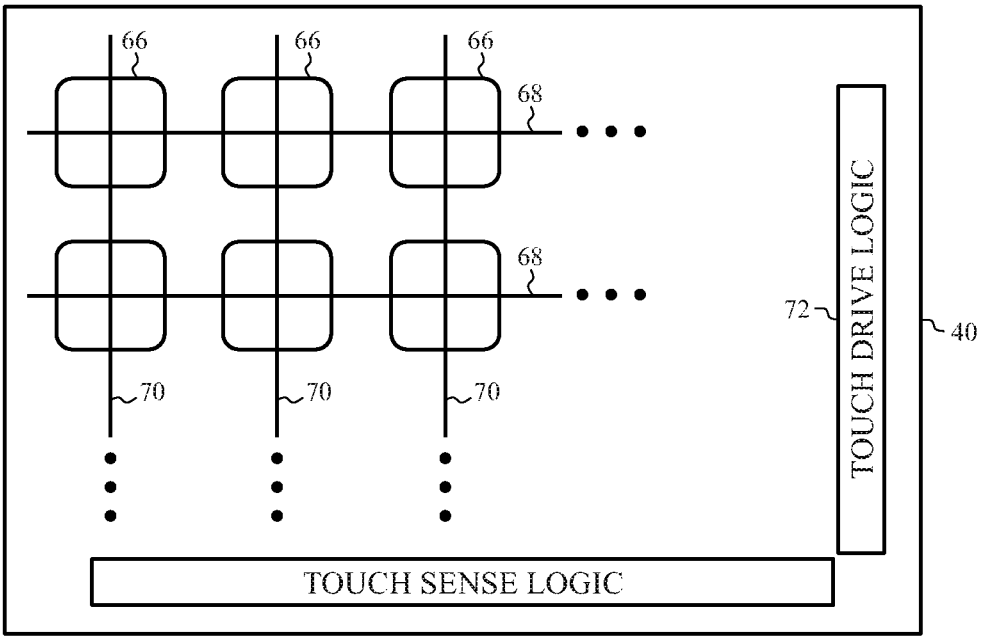
FIG. 7 is a schematic diagram of touch sensing components of the electronic display, in accordance with an embodiment.

Similarly, in embodiments with touch sensing, the touch sensing components 40 may include any suitable components used to detect occurrence and/or presence of a user touch on the surface of the display 12. For example, as illustrated in FIG. 7, the touch sensing components 40 may include a number of touch pixels 66 disposed in a pixel array or matrix. More specifically, each touch pixel 66 may be defined at the intersection of a touch drive line 68 and a touch sense line 70. Although only six touch pixels 66 are shown for purposes of simplicity, it should be understood that in an actual implementation, each touch drive line 68 and touch sense line 70 may include hundreds or thousands of such touch pixels 66.

As described above, in some embodiments, occurrence and/or position of a user touch may be detected based on impedance changes caused by the user touch. To facilitate detecting impedance changes, the touch sensing components 40 may include touch drive logic 72 and touch sense logic 74. More specifically, the touch drive logic 72 may output touch drive signals at various frequencies and/or phases on the touch drive lines 68. When an object, such as a user finger, contacts the surface of the display 12, the touch sense lines 70 may respond differently to the touch drive signals, for example by changing impendence (e.g., capacitance).

More specifically, the touch sense lines 70 may generate touch sense signals to enable the touch sense logic 74 to determine occurrence and/or position of the object on the surface of the display 12.

In some embodiments, the touch sensing components 40 may utilize dedicated touch drive lines 68, dedicated touch sense lines 70, or both. Additionally or alternatively, the touch drive lines 68 and/or the touch sense lines 70 may utilize one or more of the display components 38. For example, the touch drive lines 68 and/or the touch sense lines 70 may be formed from one or more gate lines 44, one or more pixel electrodes 50, one or more common electrodes 52, one or more source lines 46, or any combination thereof.

Figure 5:
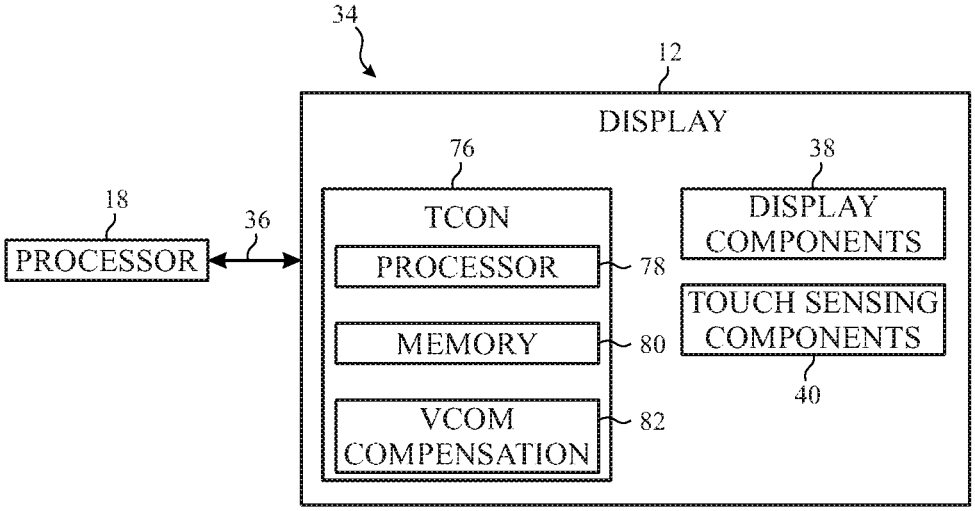
FIG. 5 is block diagram of a portion of the computing device of FIG. 1 used to display images and sense user touch, in accordance with an embodiment.

To facilitate controlling operation of both the display components 38 and/or the touch sensing components 40, the display 12 may include a timing controller (TCON) 76 as depicted in FIG. 5. Accordingly, the timing controller 76 may include a processor 78 and memory 80. More specifically, the processor 78 may execute instructions stored in memory 80 to perform operations in the display 12. Additionally, memory 80 may be a tangible, non-transitory, computer-readable medium that stores instructions executable by and data to be processed by the processor 78. The TCON 76 may also include VCOM compensation 82 that reduces or eliminates VCOM settling duration to reduce or eliminate artifacts for the display. Additionally or alternatively to location within the TCON 76, VCOM compensation circuitry may located within systems on chips (SoC) and/or column drivers of the electronic device 10. Furthermore, in certain embodiments, VCOM compensation instructions may be stored in the memory 20 to be executed by the processor 18 to compensate for VCOM fluctuations due to coupling to the dataline while pixels are being written.

Moreover, in embodiments with touch sensing, the timing controller 76 may instruct the display components 38 to write image data to the display pixels 42 and instruct the touch sensing components 40 to check for a user touch. As described above, the frequency the touch sensing components 40 detects whether a user touch is present may be increased to improve the user touch detection accuracy. In fact, the timing controller 76 may utilize intra-frame pauses by alternating between instructing the display components 38 to write a portion of an image frame and instructing the touch sensing components 40 to check for a user touch.

VCOM Compensation

Figure 8:
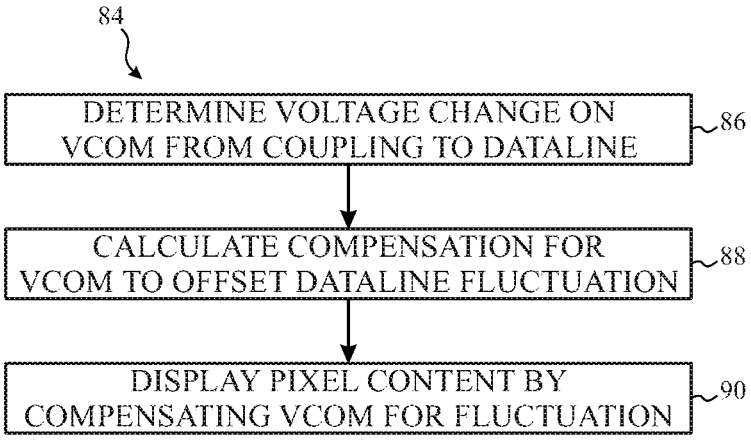
FIG. 8 is a flow diagram of a process for reducing or eliminating display artifacts by compensating for VCOM variations based on VCOM coupling to one or more datalines, in accordance with an embodiment.

As previously discussed, when a VCOM is paired to a dataline when pixel content is being written to a pixel, the VCOM voltage may fluctuate and result in an artifact on the display screen. For example, in some scenarios, if the VCOM charge fluctuation exceeds a certain value (e.g., 10 mV), the pixel may appear greenish. FIG. 8 illustrates a process 84 used by the display 12 to compensate for VCOM voltage fluctuations between images and/or changes to pixels. The processor 18 and/or the compensation circuitry determine a voltage change on the VCOM from coupling to a dataline (block 86). As discussed below, the voltage change may be pre-determined before coupling the VCOM to the dataline, at the time of connection of the VCOM to the dataline, and/or determined after the VCOM is coupled to the dataline. Furthermore, as discussed below, determination of the voltage may be made explicitly using charge calculations and/or made using hardware compensation that compensates for analog voltages as the determination. Based on the determination, the processor 18 and/or the compensation circuitry calculates a compensation for the VCOM by adjusting the VCOM in the opposite direction to compensate for the fluctuation (block 88). The display 12 then displays pixel content by compensating for VCOM fluctuations (block 90). By adjusting the VCOM to a value that compensates for the VCOM fluctuation, appearance of VCOM fluctuation artifacts may be reduced or eliminated.

Pre-Calculated VCOM Compensation

Figure 9:
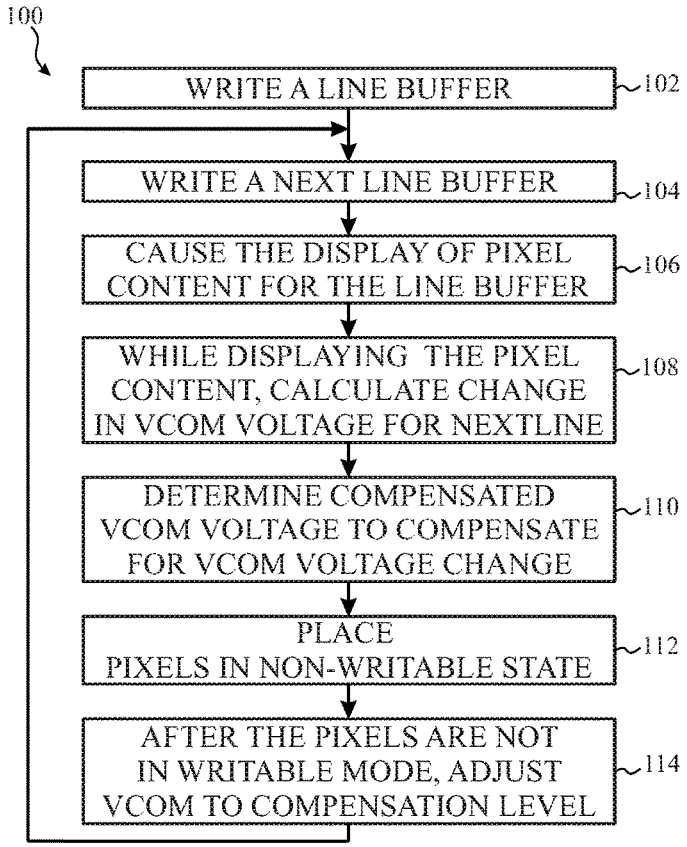
FIG. 9 is a flow diagram of a detailed process of FIG. 8 including pre-compensation for VCOM variations, in accordance with an embodiment.

FIG. 9 illustrates an embodiment of a process 100 for pre-compensating for VCOM fluctuations when coupled to the dataline where VCOM voltages are pre-compensated. The processor 18 writes pixel content to a line buffer (block 102). In certain embodiments, the line buffer may be embodied in a hardware buffer and/or software buffer as allocated space in existing memory. Moreover, such buffers may be located in the memory 20 and/or the memory 80 of the TCON 76. Additionally or alternatively, the buffer may be located in an SoC or column driver of the display 12. Furthermore, the line buffer may contain pixel content for less than an entire row or line of pixels across a display. For example, if the line buffer is in a TCON, the line buffer may store pixel content for the pixels that correspond to the TCON that only account for a portion of pixels horizontally or vertically located across a display. The processor 18 also writes data to a next line buffer that includes pixel content for a next line (block 104). Furthermore, the next line buffer may refer contain pixel content for another line in a single frame (e.g., successive rows), pixel content for the same line as the line buffer, and/or some combination thereof. The processor 18 then causes the display 12 to display the pixel content of the line buffer (block 106). For example, if the line is in the same frame as the next line, a scan of the display would include writing the pixel content from the line buffer before writing the pixel content from the next line buffer even in the same frame of pixel content.

While displaying the pixel content of the line buffer, the processor 18 calculates a change of charge in the dataline between the pixel contents and resultant change in the VCOM from the change in dataline change (block 108). For example, a processor 18 may calculate a voltage charge dumped into a dataline during a dataline transition using the following equation:

$$Q=C\Sigma V_\text{change}_{data_i}*\text{Polarity}_{data_i} \quad \text{(Equation 1)}$$

, where C is dataline capacitance to the VCOM, V_change is the pixel voltage change from the current line to the next line, and polarity (−1 or 1) indicates a voltage swing direction for the pixels. In some embodiments, the capacitance may be determined using empirical determinations, calculations, and/or other suitable means for determining or estimating capacitance between the dataline and the VCOM. Using this value, the processor 18 determines a compensated VCOM voltage level to compensate for VCOM variation due to coupling with the dataline (block 110). By calculating this charge, a VCOM driver can use a compensated VCOM to compensate for VCOM fluctuations caused by the VCOM and dataline coupling based at least in part on the polarity of the current data signal. The electronic device 10 then places at least some of the pixels corresponding to the linebuffers in a non-writeable state (block 112).

After the pixels are not in the writeable mode, the processor 18 causes the VCOM driver to adjust the VCOM to the compensation level (block 114). The processor 18 then writes a new next line and uses the previous next line as the current line and continues to compensate for charge fluctuations in the VCOM due to dataline coupling to the VCOM. Moreover, the compensated VCOM is used when writing the display for the original next line (and now current line) since the VCOM voltage level has been set to the compensated level for the next line to be written. Then, the electronic device 10 continues displaying future pixels using compensated VCOM values.

Figure 10:
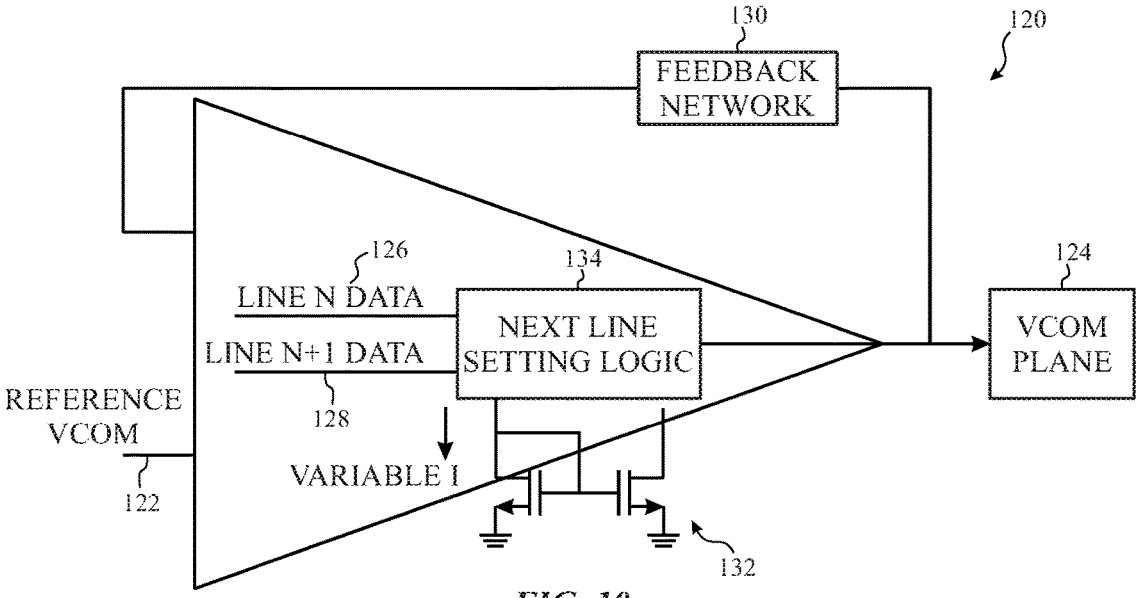
FIG. 10 illustrates a schematic view of compensation circuitry that may be used to perform the VCOM compensation of FIG. 9, in accordance with an embodiment.

FIG. 10 illustrates a compensation circuit 120 with a bias current boost, in accordance with an embodiment. In some embodiments, the bias current boost is based on a calculated next line VCOM charge determined using the foregoing processes. The compensation circuit 120 may include an input reference VCOM voltage 122 that provides a baseline from which the VCOM compensation is to occur before being sent to the VCOM plane 124 to be used by the connected pixels. The compensation circuit 120 also receives line n data 126 and line n data 128. The compensation circuit 120 further includes a feedback network 130 to receive various data about the VCOM voltages and/or related pixels, such as the previous VCOM voltage and previous dataline charge among other data. The compensation circuit 120 may also include a current mirror 132 to provide a current to next line current setting logic 134. The next line setting logic 134 determines how much current to inject into the VCOM plane 124 to offset the charge variations on the VCOM plane 124 resulting from coupling the VCOM plane 124 to one or more datalines. The next line setting logic 134 then causes the compensating current/voltage to be sent to the VCOM.

Furthermore, the illustrated compensation circuit 120 may be used to compensate for VCOM variations since, in some embodiments, a large bias would be used rarely if at all. For small disturbances to the VCOM plane 124 may be compensated easily with a relatively small bias current, and smaller bias currents consume less power. Moreover, even large bias voltages are pre-compensated. Thus, large changes may be made the VCOM plane 124 without causing substantial changes to an appearance of a display if any changes are made. Furthermore, the pre-compensated VCOM values may be set since these compensations would not result in a panelized regular image pattern.

Figure 11:
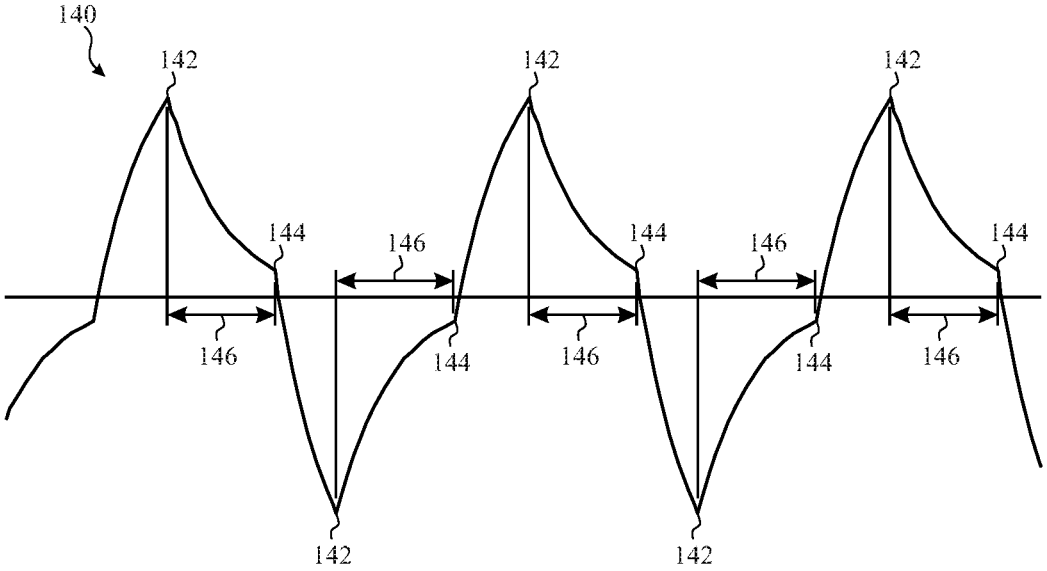
FIG. 11 illustrates a graphical view of uncompensated VCOM variations, in accordance with an embodiment.
Figure 12:
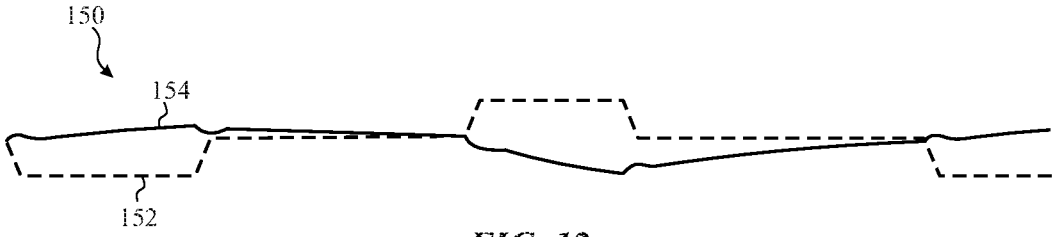
FIG. 12 illustrates a graphical view of compensated VCOM variations, in accordance with an embodiment.

FIG. 11 illustrates a graphical view of VCOM voltage variation 140 occurring from the VCOM coupling to one or more datalines. As illustrated, the VCOM voltage variation 140 includes a variation peak 142 that results from the VCOM coupling to one or more datalines. The variation peak 142 has a greater magnitude than a VCOM voltage level 144 appropriate for the pixel content before coupling the VCOM to the one or more datalines. As illustrated, the variation peak 142 takes a settling time 146 before returning to the appropriate level. During the settling time 146, the VCOM variations may cause an appearance of the display 12 to include artifacts. FIG. 12 illustrates a graphical view 150 of a compensated VCOM pulse 152 used to compensate for the VCOM variations 154. As illustrated, the magnitude of the variations on the VCOM have been reduced thereby reducing or eliminating display artifacts resulting from VCOM variations occurring due to the coupling of the VCOM to one or more datalines.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method, comprising:

determining a voltage change of one or more pixels from a first frame to a second frame to be displayed on a display;

calculating a variation of a common voltage due to the voltage change of the one or more pixels and coupling the common voltage to one or more data lines of the display;

determining an offset for common voltage to offset the calculated variation;

compensating the common voltage using the determined offset; and writing pixel content to the one or more pixels using the compensated common voltage wherein compensating the common voltage comprises pre-compensating the common voltage before writing the one or more pixels using the compensated common voltage.

2. The method of claim 1, wherein calculating the calculated variation comprises summing voltage changes of the one or more pixels from a current line to a next line scaled by a polarity of the voltage change.

3. The method of claim 1, wherein compensating the common voltage comprises injecting charge in the common voltage.

4. The method of claim 3, comprising placing the one or more pixels in a non-writable state prior to compensating the common voltage, wherein compensating the common voltage comprises applying the charge to the common voltage during the non-writable state.

5. The method of claim 4, comprising placing the one or more pixels in a writable state before writing pixel content to the one or more pixels and maintaining application of the charge through at least a portion of the writing the pixel content to the one or more pixels.

6. An electronic device, comprising:

a display, comprising:

common voltage compensation circuitry for the display, comprising:

voltage calculation circuitry configured to:

calculate a variation of a common voltage coupling the common voltage to one or more data lines of the display; and determine an offset for common voltage to offset the calculated variation;

common voltage driving circuitry configured to drive the common voltage using the determined offset to form a compensated common voltage; and display driving circuitry configured to write pixel content to one or more pixels using the compensated common voltage, wherein driving the common voltage using the determined offset comprises pre-compensating the common voltage before writing the pixel content to the one or more pixels using the compensated common voltage.

7. The electronic device of claim 6, wherein the display comprises a timing controller, and wherein the voltage calculation circuitry comprises at least a portion of the timing controller of the display.

8. The electronic device of claim 6, wherein the display comprises a column driver, and wherein the voltage calculation circuitry comprises at least a portion of the column driver of the display.

9. The electronic device of claim 6, wherein the common voltage compensation circuitry comprises:

a first line buffer configured to store pixel content for a first set of pixel content; and a second line buffer configured to store pixel content for a second set of pixel content.

10. The electronic device of claim 9, wherein the pixel content for the first set of pixel content comprises currently displayed pixel content, and the pixel content for the second set of pixel content comprises pixel content to be displayed after the currently displayed pixel content.

11. The electronic device of claim 10, wherein the pixel content to be displayed after the currently displayed pixel content comprises pixel content in a subsequent frame to a frame containing the currently displayed pixel content.

12. The electronic device of claim 6, wherein the common voltage compensation circuitry comprises a current mirror configured to provide current to the common voltage driving circuitry for injection into the common voltage.

13. Voltage compensation circuitry, comprising voltage calculation circuitry configured to:

calculate a variation of a common voltage due coupling the common voltage to one or more data lines of a display; and determine an offset for common voltage to offset the calculated variation; and common voltage driving circuitry configured to compensate the common voltage using the determined offset, wherein the common voltage driving circuitry is configured to cause an injection of charge into the common voltage; and display driving circuitry configured to write pixel content to one or more pixels using the compensated common voltage.

14. The voltage compensation circuitry of claim 13, configured to determine calculate the calculated variation based on a voltage change in the data lines determined from a first line buffer to a second line buffer while pixel content in the first line buffer is being displayed before pixel content in the second line buffer is displayed.

15. One or more non-transitory, computer-readable media having instructions stored thereon that, when executed, are configured to cause a processor to:

write pixel content of a current line of pixels to a first line buffer;

write pixel content of a subsequent line of pixels to a second line buffer;

predict a voltage change of at least one pixel corresponding to the pixel content from the first line buffer to the second line buffer;

cause coupling of a common voltage to a data line of a display corresponding to the first line buffer;

calculate a common voltage variation due to the predicted voltage change of the at least one pixel;

determine an offset for common voltage to offset the calculated common voltage variation;

compensate the common voltage using the determined offset; and cause pixel content of the second line buffer to be written to the subsequent line of pixels using the compensated common voltage.

16. The one or more non-transitory, computer-readable media of claim 15, wherein the first and second line buffers are stored in memory of a timing controller of the display, general memory of an electronic device, memory of a column driver of the display, or in memory of a system on chip of the electronic device.

17. The one or more non-transitory, computer-readable media of claim 15, wherein at least a portion of the one or more non-transitory, computer-readable media is stored in the display.

18. The one or more non-transitory, computer-readable media of claim 15, wherein after the pixel content of the second line buffer is written to the subsequent line of pixels using the compensated common voltage the pixel content of the second line buffer becomes currently displayed pixel content, and the processor is configured to cause the processor to write new subsequent pixel content to the first line buffer.

* * * * *